United States Patent [19]

Shimada et al.

[11] Patent Number: 4,844,865

[45] Date of Patent: Jul. 4, 1989

[54] SEAWATER-CORROSION-RESISTANT NON-MAGNETIC STEEL MATERIALS

[75] Inventors: Haruo Shimada; Yoshiaki Sakakibara, both of Kawasaki, Japan

[73] Assignee: Nippon Steel Corporation, Tokyo, Japan

[21] Appl. No.: 125,601

[22] Filed: Nov. 25, 1987

[30] Foreign Application Priority Data

Dec. 2, 1986 [JP] Japan ..... 61-287220

[51] Int. Cl.[4] ..... C22C 38/02

[52] U.S. Cl. ..... 420/79; 420/62; 420/63; 420/40; 420/41; 420/80; 420/81

[58] Field of Search ..... 420/41, 40, 62, 63, 420/79, 80, 81, 583

[56] References Cited

U.S. PATENT DOCUMENTS 1,990,650 2/1935 Jaeger ..... 420/79
2,946,676 7/1960 Brennan et al. ..... 420/583

FOREIGN PATENT DOCUMENTS 48054 3/1982 Japan .
58-93856 6/1983 Japan ..... 420/62
44457 3/1984 Japan .

OTHER PUBLICATIONS

"Offshore Goteborg '81", paper No. 42, Goteborg Sweden, 1981.
"Cement Concrete" No. 434 (1983), pp. 23 to 31.
"Corrosion of Reinforcement in Concrete Construction" pp. 419 to 434, 1983.
"Kenchiku No Gijutsu Seko" (Practice for Building Construction) No. 229, 1985, Jan., pp. 155 to 164, published by Shokokusha, Japan.

*Primary Examiner*—Deborah Yee
*Attorney, Agent, or Firm*—Wenderoth, Lind & Ponack

[57] ABSTRACT

A non-magnetic steel material suitable for use in various steel and concrete structures such as magnetic floating high-speed railways, nuclear fusion facilities and marine structures and appliances where non-magnetic properties are required. The steel composition contain (by weight):

C:-not more than 1.0%
Si: not more than 0.25%
Mn: not more than 2.0%
Al: more than 20.0 to 37.3%
P: not more than 0.015%
S: not more than 0.005%
Cr: more than 5.5 to 15.0% and may further contain at least one of Ti, V, Nb, W, Co, Mo and B in an amount ranging from 0.01 to 0.5% for the elements other than B, and in an amount ranging from 0.0001 to 0.005% for B, and at least one of Cu and Ni in an amount ranging from 0.1 to 5.5%.

16 Claims, No Drawings

SEAWATER-CORROSION-RESISTANT NON-MAGNETIC STEEL MATERIALS

BACKGROUND OF THE INVENTION

1. Field of the Invention:

The present invention relates to non-magnetic steel materials suitable for use in various steel and concrete structures, such as magnetic floating high-speed railways, nuclear fusion facilities and marine structures and appliances where a non-magnetic property is required.

The steel materials suitable for the above applications must have good corrosion resistance, and therefore the present invention particularly concerns non-magnetic steel compositions useful for preventing the decay of marine steel and concrete structures and similar structures which may be built on seashores.

In recent years, various preventive methods for preventing the decay of steel and concrete structures which are built on the ocean and seashores have been proposed, and indeed some of these have already been put into practice.

The principal causes for the decay of steel structures include the corrosion by the seawater itself and corrosion by the sea salt particles. Meanwhile, the principal cause for the decay of concrete structures has been found to be attributable to the fact that reinforcing steel bars or wires embedded in the concrete structure are corroded by salts contained in sea sand used when mixing the concrete, or by sea salt particles which permeate into a concrete structure built on a seashore or in seawater. The corrosive salts have an increased volume of about 2.2 times the iron, and the concrete fails to withstand the expansion forces of the corroding steel bars or wires. The concrete thus cracks along the embedded reinforcing bars or wires. When the cracks grow to about 0.2 mm or larger, external corrosive media, such as oxygen, salts, and carbon dioxide in the air, penetrate these cracks to reach the interior of the concrete mass where the reinforcing bars or wires are embedded. This further promotes the corrosion of the bars or wires, or accelerates neutralization of the concrete, causing premature decay of the concrete structures.

2. Description of the Related Art:

For the purpose of preventing such decay of concrete structures, the present inventors have conducted extensive studies and experiments to improve the salt resistance of the reinforcing steel bars or wires, by controlling their chemical composition. As a result, concrete reinforcing steel bars or wires have been developed which have significantly improved salt resistance, as disclosed in Japanese Laid-Open Patent Application Nos. Sho 57-48054 and Sho 59-44457, and as widely published in "Offshore Goteborg '81", Paper No. 42, Goteborg Sweden, 1981; "Cement Concrete" No. 434 (1983), Pages 23 to 31; "Corrosion of Reinforcement in Concrete Construction" page 419, 1983; and "Kenchiku No Gijutsu Seko" (Practice for Building Construction) No. 229, 1985, Jan. Pages 155 to 164, published by Shokokusha, Japan.

Also, details of the salt resistance mechanism at the initial stages of steel compositions for reinforcing bars or wires and which contribute to improving the salt resistance of reinforcing bars or wires per se are reported in these technical papers.

Also, in recent years, trials have been made at preparing steel materials containing 15% or more manganese for the purpose of obtaining non-magnetic properties, but one critical problem confronted by all of these Mn-containing steel materials is that the rust generation rate is remarkable, and higher than ordinary carbon steel; hence a higher corrosion rate is experienced with the presence of a very small amount of salt.

SUMMARY OF THE INVENTION

Therefore, a main object of the present invention is to provide a steel material which can substantially prevent the corrosion of structures built therewith and also the decay of concrete structures reinforced with such steel wires, which structures may be built on the seashores.

The problems of steel corrosion and concrete decay in marine environments have been given keen attention in various fields of industries. More imminent problems now to be solved are those in connection with concrete structures more than 20 years old. In many fields, the free salt content around the reinforcing bars or wires embedded in old concrete structures may be as high as 1.0% in terms of NaCl in severe marine environments, and this causes serious corrosion of the reinforcing bars or wires, which in turn causes and promotes cracking of the concrete.

Therefore, it has been strongly desired to have a steel material resistant to attack by a high concentration of free salt, thus almost completely eliminating the possible corrosion of a steel structure and cracking of a concrete structure, which may be exposed to a very high concentration of salt.

Accordingly, this invention provides a seawater-corrosion-resistant non-magnetic steel material suitable for use in building steel structures and reinforcing concrete structures, which steel material consists of (by weight) not more than 1.0% carbon, not more than 0.25% silicon, not more than 2.0% manganese, more than 20.0 to 37.3% aluminium, not more than 0.015% phosphorous, not more than 0.005% sulphur, and more than 5.5 to 15.0% chromium, with the balance being iron and unavoidable impurities.

Optionally the steel materials may contain 0.01 to 0.5% of rare earth elements such as Ce, La and Y, singly in or in combination.

Further the steel material may contain one or more of Ti, V, Nb, W, Co, Mo and B, in an amount ranging from 0.01 to 0.5% for the elements other than B, and in an amount ranging from 0.0001 to 0.005% for B. Still further the steel material may contain one or more of Cu and Ni in an amount ranging from 0.1 to 5.5%. The optional additive elements may be added to the basic steel composition singly or in combination.

DETAILED DESCRIPTION OF THE INVENTION

The most important feature of the present invention resides in that relatively large amounts of Al and Cr are contained in the steel so as to lower the Si and S contents in the steel and also to obtain a stabilized non-magnetic property, and an additional feature lies in that a small amount of rare earth elements such as Ce, La and Y is added for improving the hot workability of the steel.

The advantage obtained by the limitation of the Si and S contents in the steel and the relatively large content of Al will now be described. The lowered Si content in the steel will suppress the formation and growth of rust, and the content of MnS which creates the nuclei for rust formation is markedly lowered along with the lowering of the S content in the steel so that the deterioration of the corrosion resistance can be minimized. The increased Al content in the steel will strengthen the passivated film formed on the surface of the high-manganese steel so that the passivated film, even if exposed to a high concentration of salt, is not destroyed, thus preventing rust formation.

An explanation will be made on the reasons for limiting the contents of the individual elements, as defined in the present invention.

Carbon is limited to an amount of not more than 1.0% for the reason that more than 1.0% carbon will cause embrittlement of the steel. A lower carbon content is more desirable because carbon has a large tendency, when heated during heat treatment, to form magnetic complex carbides such as $(Fe, Al)_3C$. A preferable carbon range is not more than 0.2%, more preferably from 0.001 to 0.1%.

The reason for limiting the Si content to an amount of not more than 0.25% is that Si is necessary to assure the required strength of the steel and to control the non-metallic inclusions, but a lower Si content will markedly suppress the rust formation. For these conflicting purposes, the Si content is limited to an amount of not more than 0.25%. A preferable Si content is not more than 0.05%.

The Mn content is limited to an amount of not more than 2.0% because Mn contents of more than 2.0% will cause difficulties in hot rolling. From the point of rust prevention, Mn contents of not more than 1.0% are preferable.

The P content is limited to an amount of not more than 0.015% for the reason that P contents of more than 0.015% produce no effect to suppress rust formation in an alkaline environment such as concrete, but rather tend to promote rust formation.

Aluminium is the most important metal element in the steel composition according to the present invention. The reason for limiting the Al content to an amount ranging from more than 20.0 to 37.3% is that with Al contents of 20.0% or less the de-magnetization of the steel is not sufficient, but with Al contents of more than 37.3%, there is a great tendency to produce intermetallic compounds between Al and Fe, which cause embrittlement of the steel, thus prohibiting hot rolling. A preferable Al content ranges from 20.5 to 28.0%.

The S content is limited to an amount of not more than 0.005% for the purpose of reducing the content of MnS, which is the cause for the formation of rust. Incidentally, Ca and rare earth elements used as desulfurizing agents to lower the S content may convert MnS into (Mn,Ca)S and so on; thereby additional corrosion resistance improvement can be expected.

The above procedure for lowering the sulphur content is a common practice widely done in the art and it is very often that the steel contains a small amount of Ca and rare earth metal elements such as Ce, but the presence of these elements is permissible because they will not produce adverse effects on the corrosion resistance of the steel.

The Cr content is limited to an amount more than 5.5% but not more than 15.0% for the reason that Cr contents more than 5.5% will improve the hot workability of the steel when the Al content is more than 20.0%, but the Cr contents more than 15% will in some cases cause embrittlement of the steel. The most preferable range of the Cr content is from 7.0 to 10.0%.

The rare earth elements such as Ce, La, and Y have a very strong affinity with oxygen, and can modify the properties of the oxides formed on the steel surface when the steel is heated, thus remarkably improving the workability of the steel during hot rolling and producing a markedly improved surface quality of the hot rolled steel. These favorable effects can not be obtained when the content of the rare earth element is less than 0.01% and more than 0.5%. Therefore, the total content of the rare earth element is limited to the range of from 0.01 to 0.5% singly or in combination.

According to the present invention, Ti, V, Nb, W, Co, Mo and B may be added when desired to improve the strength and toughness of the steel as conventionally done. One or more of these elements can be added in a total amount ranging from 0.01 to 0.5% either alone or in combination for the elements other than B, and in an amount ranging from 0.0001 to 0.005% for B. The addition of these elements for the above purpose is conventionally known. As these optional elements more often produce similar effects, two or more of these elements are usually added in combination to achieve the desired purpose.

Further, when required, one or more of Cu and Ni may be added in a total amount ranging from 0.1 to 5.5%.

Still further, for applications such as screwed concrete reinforcing wires where a free cutting property is required, 0.01 to 0.5% Pb may be added.

A steel having the chemical composition mentioned hereinbefore may be prepared by melting the steel components in a converter or electric furnace. The steel is then subjected to ingot-making and breaking down, or to continuous casting, then to rolling and heat treatments such as quenching, annealing, normalizing and patenting, if necessary and finally drawing into bars or wires for final use. However, the final products may be supplied in the form of pipes, H-sections, concrete reinforcing bars, wires, and sheets, and if required may further be applied with Zn coatings or organic coatings.

DETAILED DESCRIPTION OF THE PREFERRED EMBODIMENTS

The present invention will be better understood from the following description of certain specific Examples thereof.

EXAMPLE 1

Steels having the chemical compositions shown in Table 1 were melted in a vacuum melting furnace, and subjected to ingot-making, breaking down and then hot rolling. Comparative corrosion tests were made with conventional steel compositions and the results are shown in the table.

The test pieces were prepared by sampling a piece of 25 mm in width, 60 mm in length and 2 mm in thickness from the central portion of the rolled sheet as prepared above and mechanically grinding the surface of the piece. On the other hand artificial seawater was prepared to provide a laboratory simulation environment to promote or reproduce the corrosion of the steels actually used on the seashores and in the seawater.

Then the test pieces surface-ground as above were covered with silicone resin on both the front and back sides, degreased, dried, and then immediately immersed in the artificial seawater. The seawater was replaced every 7 days and the immersion was continued for 50 days to observe the rust formation.

Then, for the purpose of promoting or reproducing the corrosion by salt of reinforcing steel wires embedded in concrete, an aqueous solution of $Ca(OH)_2+NaCl$ (pH 12) was prepared by dissolving CaO (which is the main component of concrete) into 3.6% NaCl solution.

Then the test pieces surface ground as above were covered with silicone resin on both sides, degreased, dried and then immediately immersed in the aqueous solution above prepared. During the test period, the surface of the solution was sealed with floating paraffin, and the solution was replaced every three days. The immersion was continued for 20 days to observe the rust formation. The results are shown in Table 1.

EXAMPLE 2

Hot rolled steel sheets having the chemical compositions shown in Table 1 were surface ground and exposed on the seashore for one year to observe the rust formation.

Also hot rolled steel bars (9 mm in diameter) having the chemical compositions shown in Table 1 were embedded in concrete motar composed of sand containing 1.0% NaCl, portland cement, water and aggregates and aged for 28 days at room temperatures and then exposed on the seashroe for one year. The ratio of water to cement in the concrete was 0.60 and the embedding depth was 2 mm.

After a one-year exposure as above, the concrete was broken to observe the rust formation.

As understood from the results shown in Table 1, the steel materials according to the present invention show no rust formation in the seawater nor even in concrete containing salt, as high as 1.0% NaCl contained in the sand, and 3.6% NaCl contained in the water, so that concrete decay caused by rust formation and growth on the reinforcing steel bars embedded therein can be completely prevented. Therefore it can be presumed that the steel materials according to the present invention, when used in steel structures and concrete structures built on the seashores or on the ocean, can prevent the decay of the structures even under very severe marine conditions.

The steel materials according to the present invention can assure the durability of structures built with non magnetic steel materials as well as concrete structures reinforced with non-magnetic steel bars, exposed to salt attack, and can be used in wide applications including magnetic floating railways where the non-magnetic property is required and which may be built on seashores and exposed to salt attack.

TABLE 1

| | Chemical Composition (weight %) | | | | | | | | |
|---|---|---|---|---|---|---|---|---|---|
| No. | C | Si | Mn | P | S | Al | Cr | Rare Earth Elements | Others |
| Conventional Steels | | | | | | | | | |
| 1 | 0.17 | 0.26 | 30.5 | 0.019 | 0.022 | 0.010 | | | Cu 0.3, Ni 0.1 |
| 2 | 0.58 | 0.27 | 26.1 | 0.012 | 0.009 | 0.021 | 5.9 | | |
| 3 | 0.71 | 0.24 | 18.1 | 0.012 | 0.007 | 0.029 | | | |
| Present Steels | | | | | | | | | |
| 4 | 0.002 | 0.02 | 0.21 | 0.005 | 0.005 | 21.2 | 10.1 | | |
| 5 | 0.003 | 0.02 | 0.05 | 0.008 | 0.003 | 21.8 | 12.1 | | |
| 6 | 0.001 | 0.02 | 0.20 | 0.009 | 0.002 | 22.5 | 8.7 | | |
| 7 | 0.005 | 0.10 | 0.50 | 0.008 | 0.003 | 22.8 | 8.6 | | |
| 8 | 0.002 | 0.03 | 0.30 | 0.010 | 0.002 | 21.5 | 9.0 | | |
| 9 | 0.007 | 0.05 | 0.30 | 0.010 | 0.003 | 24.0 | 12.0 | | |
| 10 | 0.20 | 0.03 | 0.30 | 0.015 | 0.002 | 21.7 | 8.8 | | |
| 11 | 0.003 | 0.03 | 0.30 | 0.011 | 0.002 | 25.7 | 9.8 | | |
| 12 | 0.002 | 0.02 | 0.20 | 0.011 | 0.001 | 25.8 | 8.9 | | |
| 13 | 0.001 | 0.12 | 0.30 | 0.010 | 0.002 | 26.5 | 13.6 | | |
| 14 | 0.001 | 0.03 | 0.30 | 0.015 | 0.001 | 21.0 | 8.8 | Ce 0.05 | |
| 15 | 0.008 | 0.03 | 0.20 | 0.008 | 0.001 | 22.8 | 19.0 | Ce 0.1 | |
| 16 | 0.002 | 0.02 | 0.32 | 0.008 | 0.001 | 22.9 | 8.7 | Ce 0.1, Y 0.05 | |
| 17 | 0.003 | 0.03 | 0.31 | 0.010 | 0.002 | 23.8 | 10.2 | Ce 0.1, Ca < 0.002 | |
| 18 | 0.004 | 0.02 | 0.20 | 0.009 | 0.003 | 22.4 | 9.7 | Y 0.05 | |
| 19 | 0.010 | 0.03 | 0.31 | 0.011 | 0.002 | 21.5 | 9.8 | Y 0.05, Ca < 0.0002 | |
| 20 | 0.008 | 0.02 | 0.27 | 0.008 | 0.003 | 25.0 | 8.0 | Ce 0.1, La 0.01, Ca < 0.0001 | |
| 21 | 0.002 | 0.10 | 0.30 | 0.010 | 0.002 | 24.7 | 8.7 | Ce 0.05, Y 0.05, La 0.01 | |
| 22 | 0.001 | 0.05 | 0.31 | 0.012 | 0.001 | 23.7 | 8.2 | Ce 0.08, Ca < 0.0002 | |
| 23 | 0.010 | 0.03 | 0.27 | 0.008 | 0.002 | 22.8 | 8.7 | La 0.05, Ca < 0.0002 | |
| 24 | 0.001 | 0.05 | 0.30 | 0.008 | 0.002 | 22.3 | 8.7 | | Ni 3.5 |
| 25 | 0.03 | 0.01 | 0.30 | 0.008 | 0.002 | 22.7 | 9.1 | | Ti 0.25 |
| 26 | 0.002 | 0.02 | 0.30 | 0.005 | 0.002 | 22.8 | 8.8 | | Ti 0.08, V 0.2 |
| 27 | 0.002 | 0.01 | 0.20 | 0.003 | 0.001 | 23.2 | 8.7 | | Nb 0.05 |
| 28 | 0.05 | 0.02 | 0.20 | 0.012 | 0.001 | 25.8 | 8.0 | | Ti 0.05, Mo 0.2 |
| 29 | 0.18 | 0.03 | 0.30 | 0.012 | 0.005 | 22.6 | 8.0 | | W 0.10 |
| 30 | 0.05 | 0.02 | 0.30 | 0.014 | 0.002 | 27.8 | 8.1 | | Ti 0.03, B 0.001 |
| 31 | 0.05 | 0.02 | 0.20 | 0.007 | 0.001 | 25.8 | 8.8 | | Ti 0.15, Mo 0.2 |
| 32 | 0.007 | 0.03 | 0.30 | 0.008 | 0.005 | 22.6 | 9.0 | | W 0.15 |
| 33 | 0.008 | 0.03 | 0.20 | 0.008 | 0.002 | 22.9 | 9.1 | Ce 0.1 | Ni 3.48 |
| 34 | 0.012 | 0.03 | 0.21 | 0.007 | 0.001 | 23.0 | 8.8 | Ce 0.1 | Ti 0.15 |
| 35 | 0.020 | 0.02 | 0.25 | 0.009 | 0.003 | 21.2 | 10.1 | Ce 0.1, Y 0.05 | Ti 0.10, V 0.2 |
| 36 | 0.012 | 0.03 | 0.18 | 0.008 | 0.001 | 23.1 | 10.2 | Ce 0.08, Ca < 0.0002 | Nb 0.08 |
| 37 | 0.013 | 0.02 | 0.21 | 0.008 | 0.002 | 20.5 | 15.0 | Y 0.08 | Ti 0.12, Mo 0.1 |
| 38 | 0.008 | 0.03 | 0.27 | 0.010 | 0.001 | 21.5 | 10.0 | Y 0.10, Ca < 0.0002 | W 0.12 |
| 39 | 0.010 | 0.03 | 0.18 | 0.007 | 0.001 | 21.5 | 12.0 | Ce 0.10, Y 0.05, La 0.01 | Ti 0.11, B 0.0001 |
| 40 | 0.011 | 0.02 | 0.21 | 0.008 | 0.002 | 26.0 | 10.0 | Ce 0.08, La 0.01 | Ti 0.13, Mo 0.1 |
| 41 | 0.008 | 0.03 | 0.27 | 0.007 | 0.001 | 22.5 | 9.0 | La 0.07, Ca < 0.0002 | W 0.17 |
| 42 | 0.05 | 0.02 | 0.30 | 0.010 | 0.002 | 26.8 | 8.8 | | Ti 0.08, B 0.001 |
| 43 | 0.01 | 0.01 | 0.20 | 0.011 | 0.002 | 23.7 | 8.9 | | Cu 2.5 |
| 44 | 0.02 | 0.01 | 0.10 | 0.007 | 0.001 | 27.0 | 8.9 | | Nb 0.03, V 0.1 |

TABLE 1-continued

| | | | | | | | | | |
|---|---|---|---|---|---|---|---|---|---|
| 45 | 0.001 | 0.03 | 0.30 | 0.008 | 0.002 | 25.0 | 8.8 | | Co 0.15 |
| 46 | 0.18 | 0.02 | 0.30 | 0.015 | 0.001 | 26.1 | 8.0 | | Nb 0.03, W 0.12 |
| 47 | 0.001 | 0.02 | 0.30 | 0.010 | 0.001 | 26.1 | 8.5 | | Nb 0.03, W 0.15 |
| 48 | 0.01 | 0.01 | 0.10 | 0.010 | 0.002 | 23.7 | 12.1 | | Cu 0.3, Nb 0.05 |
| 49 | 0.01 | 0.02 | 0.20 | 0.012 | 0.002 | 28.8 | 9.1 | | V 0.1, W 0.13 |
| 50 | 0.01 | 0.02 | 0.20 | 0.008 | 0.002 | 22.8 | 9.1 | | V 0.1, W 0.15 |
| 51 | 0.003 | 0.01 | 0.31 | 0.010 | 0.001 | 21.8 | 9.9 | | Nb 0.05, Mo 0.1 |
| 52 | 0.01 | 0.02 | 0.05 | 0.013 | 0.002 | 23.0 | 8.8 | | Co 2.0, W 0.12 |
| 53 | 0.001 | 0.01 | 0.01 | 0.010 | 0.001 | 22.8 | 9.1 | | Ni 3.5, Co 0.15 |
| 54 | 0.03 | 0.03 | 0.17 | 0.008 | 0.002 | 22.7 | 8.8 | Ce 0.1 | Ti 0.17, B 0.001 |
| 55 | 0.02 | 0.02 | 0.21 | 0.007 | 0.001 | 23.0 | 7.5 | Ce 0.1, La 0.01 | Cu 2.0 |
| 56 | 0.02 | 0.03 | 0.30 | 0.008 | 0.001 | 20.7 | 14.8 | Ce 0.05, Y 0.05 | Nb 0.08, V 0.03 |
| 57 | 0.01 | 0.02 | 0.27 | 0.005 | 0.001 | 26.0 | 7.0 | Y 0.08 | Co 0.08 |
| 58 | 0.02 | 0.03 | 0.19 | 0.007 | 0.001 | 22.8 | 9.0 | Ce 0.1, Ca < 0.0002 | Nb 0.10, W 0.12 |
| 59 | 0.008 | 0.03 | 0.20 | 0.008 | 0.002 | 22.9 | 9.0 | Ce 0.08, Y 0.05, La 0.01 | Nb 0.05, W 0.16 |
| 60 | 0.007 | 0.02 | 0.18 | 0.007 | 0.001 | 20.7 | 15.0 | La 0.05, Y 0.1 | Cu 0.5, Nb 0.05 |
| 61 | 0.010 | 0.03 | 0.22 | 0.008 | 0.002 | 21.5 | 10.0 | Ce 0.08 | V 0.12, Wo 0.13 |
| 62 | 0.010 | 0.02 | 0.20 | 0.010 | 0.001 | 22.8 | 9.1 | Ce 0.08, Y 0.05 | Nb 0.10, Mo 0.1 |
| 63 | 0.007 | 0.03 | 0.18 | 0.008 | 0.001 | 22.9 | 6.9 | Ce 0.09 | Ni 2.0, Cu 3.0 |
| 65 | 0.07 | 0.02 | 0.10 | 0.008 | 0.001 | 21.7 | 9.3 | | Ni 0.5, W 0.1 |
| 66 | 0.008 | 0.01 | 0.20 | 0.007 | 0.001 | 23.7 | 9.8 | | Cu 0.2, W 0.2 |
| 67 | 0.06 | 0.10 | 0.15 | 0.008 | 0.002 | 22.1 | 12.7 | | Cu 0.2, Ni 5.0, W 0.3 |
| 68 | 0.19 | 0.24 | 0.18 | 0.007 | 0.001 | 23.8 | 10.6 | | Ni 0.5, Mo 0.1 |
| 69 | 0.07 | 0.02 | 0.10 | 0.008 | 0.001 | 21.7 | 10.3 | | Ni 3.5, W 0.23, Nb 0.05 |
| 70 | 0.08 | 0.01 | 0.25 | 0.007 | 0.001 | 23.7 | 9.8 | | Cu 2.2, Ni 1.2 Ti 0.26 |
| 71 | 0.06 | 0.10 | 0.25 | 0.008 | 0.002 | 22.1 | 12.7 | | Cu 1.2, Ni 2.0, V 0.21 |
| 71 | 0.008 | 0.24 | 0.28 | 0.007 | 0.001 | 23.8 | 10.6 | | Cu 1.5, Ni 1.1, Mo 0.08 |
| 72 | 0.005 | 0.20 | 0.20 | 0.008 | 0.002 | 23.1 | 8.7 | | Cu 0.2, Ni 1.3, Mo 0.2 |
| 73 | 0.08 | 0.18 | 0.21 | 0.009 | 0.003 | 22.7 | 9.2 | | Mo 0.15 |
| 74 | 0.005 | 0.03 | 0.01 | 0.013 | 0.001 | 27.3 | 8.5 | | Cu 2.0, Ni 1.0, Nb 0.03 |
| 75 | 0.009 | 0.03 | 0.21 | 0.008 | 0.001 | 21.8 | 9.0 | Ce 0.1 | Ni 0.5, W 0.1 |
| 76 | 0.010 | 0.01 | 0.18 | 0.007 | 0.002 | 21.2 | 10.0 | Ce 0.1, Y 0.07 | Cu 0.2, W 0.2 |
| 77 | 0.06 | 0.10 | 0.17 | 0.008 | 0.001 | 22.1 | 12.0 | Ce 0.1, La 0.01 | Cu 0.5, Ni 5.0 W 0.3 |
| 78 | 0.01 | 0.03 | 0.30 | 0.010 | 0.002 | 23.8 | 8.0 | Ce 0.1, Ca < 0.002 | Ni 0.7, Mo 0.2 |
| 79 | 0.03 | 0.24 | 0.28 | 0.007 | 0.001 | 22.1 | 8.8 | Y 0.08 | Ni 3.5, W 0.2, Nb 0.05 |
| 80 | 0.008 | 0.18 | 0.21 | 0.008 | 0.002 | 23.2 | 8.5 | Y 0.08, La 0.01 | Cu 2.0, Ni 1.0 Ti 0.1 |
| 81 | 0.005 | 0.20 | 0.20 | 0.008 | 0.001 | 23.1 | 8.6 | La 0.08 | Cu 1.0, Ni 1.0, V 0.2 |
| 82 | 0.029 | 0.18 | 0.02 | 0.009 | 0.001 | 22.7 | 9.1 | Ce 0.08 | Cu 1.0, Ni 1.2 Nb 0.1 |
| 83 | 0.030 | 0.15 | 0.17 | 0.008 | 0.002 | 27.0 | 8.2 | Ce 0.1 | Cu 0.1, Ni 1.0, Mo 0.1 |
| 83 | 0.08 | 0.17 | 0.23 | 0.007 | 0.003 | 22.8 | 9.1 | Ce 0.08, Y 0.01 | Mo 0.20 |
| 84 | 0.02 | 0.03 | 0.18 | 0.008 | 0.001 | 22.5 | 9.0 | Ce 0.1 | Cu 2.0, Ni 1.0, Nb 0.1 |

| No. | Test Results of Seawater Resistance of Steels | | Test Results of Seawater Resistance of Steel Bars Embedded in Concrete | | Magnetic Permeability (Room Temperatures) |
|---|---|---|---|---|---|
| | Rust Formation Area after Immersion in Artificial Seawater (%) | Rust Formation Area after Exposure on Seashore (%) | Rust Formation Area after Immersion in an Aqueous Solution of $Ca(OH)_2$ + 3.6% NaCl (%) | Rust Formation Area on Steel Bars Embedded in High-Salt Concrete (%) | |
| Conventional Steels | | | | | |
| 1 | 100 | 100 | 4.7 | 26.3 | 1.002 |
| 2 | 100 | 100 | 4.1 | 12.7 | " |
| 3 | 100 | 100 | 3.8 | 25.6 | " |
| Present Steels | | | | | |
| 4 | 0 | 0 | 0 | 0 | ≦1.010 |
| 5 | 0 | 0 | 0 | 0 | " |
| 6 | 0 | 0 | 0 | 0 | " |
| 7 | 0 | 0 | 0 | 0 | " |
| 8 | 0 | 0 | 0 | 0 | " |
| 9 | 0 | 0 | 0 | 0 | " |
| 10 | 0 | 0 | 0 | 0 | " |
| 11 | 0 | 0 | 0 | 0 | " |
| 12 | 0 | 0 | 0 | 0 | " |
| 13 | 0 | 0 | 0 | 0 | " |
| 14 | 0 | 0 | 0 | 0 | " |
| 15 | 0 | 0 | 0 | 0 | ≦1.010 |
| 16 | 0 | 0 | 0 | 0 | " |

TABLE 1-continued

| | | | | | |
|---|---|---|---|---|---|
| 17 | 0 | 0 | 0 | 0 | " |
| 18 | 0 | 0 | 0 | 0 | " |
| 19 | 0 | 0 | 0 | 0 | " |
| 20 | 0 | 0 | 0 | 0 | " |
| 21 | 0 | 0 | 0 | 0 | " |
| 22 | 0 | 0 | 0 | 0 | " |
| 23 | 0 | 0 | 0 | 0 | " |
| 24 | 0 | 0 | 0 | 0 | " |
| 25 | 0 | 0 | 0 | 0 | " |
| 26 | 0 | 0 | 0 | 0 | " |
| 27 | 0 | 0 | 0 | 0 | " |
| 28 | 0 | 0 | 0 | 0 | " |
| 29 | 0 | 0 | 0 | 0 | " |
| 30 | 0 | 0 | 0 | 0 | " |
| 31 | 0 | 0 | 0 | 0 | ≦1.010 |
| 32 | 0 | 0 | 0 | 0 | " |
| 33 | 0 | 0 | 0 | 0 | " |
| 34 | 0 | 0 | 0 | 0 | " |
| 35 | 0 | 0 | 0 | 0 | " |
| 36 | 0 | 0 | 0 | 0 | " |
| 37 | 0 | 0 | 0 | 0 | " |
| 38 | 0 | 0 | 0 | 0 | " |
| 39 | 0 | 0 | 0 | 0 | " |
| 40 | 0 | 0 | 0 | 0 | " |
| 41 | 0 | 0 | 0 | 0 | " |
| 42 | 0 | 0 | 0 | 0 | " |
| 43 | 0 | 0 | 0 | 0 | " |
| 44 | 0 | 0 | 0 | 0 | " |
| 45 | 0 | 0 | 0 | 0 | " |
| 46 | 0 | 0 | 0 | 0 | " |
| 47 | 0 | 0 | 0 | 0 | ≦1.010 |
| 48 | 0 | 0 | 0 | 0 | " |
| 49 | 0 | 0 | 0 | 0 | " |
| 50 | 0 | 0 | 0 | 0 | " |
| 51 | 0 | 0 | 0 | 0 | " |
| 52 | 0 | 0 | 0 | 0 | " |
| 53 | 0 | 0 | 0 | 0 | " |
| 54 | 0 | 0 | 0 | 0 | " |
| 55 | 0 | 0 | 0 | 0 | " |
| 56 | 0 | 0 | 0 | 0 | " |
| 57 | 0 | 0 | 0 | 0 | " |
| 58 | 0 | 0 | 0 | 0 | " |
| 59 | 0 | 0 | 0 | 0 | " |
| 60 | 0 | 0 | 0 | 0 | " |
| 61 | 0 | 0 | 0 | 0 | " |
| 62 | 0 | 0 | 0 | 0 | " |
| 63 | 0 | 0 | 0 | 0 | ≦0.010 |
| 64 | 0 | 0 | 0 | 0 | " |
| 65 | 0 | 0 | 0 | 0 | " |
| 66 | 0 | 0 | 0 | 0 | " |
| 67 | 0 | 0 | 0 | 0 | " |
| 68 | 0 | 0 | 0 | 0 | " |
| 69 | 0 | 0 | 0 | 0 | " |
| 70 | 0 | 0 | 0 | 0 | " |
| 71 | 0 | 0 | 0 | 0 | " |
| 72 | 0 | 0 | 0 | 0 | " |
| 73 | 0 | 0 | 0 | 0 | " |
| 74 | 0 | 0 | 0 | 0 | " |
| 75 | 0 | 0 | 0 | 0 | " |
| 76 | 0 | 0 | 0 | 0 | " |
| 77 | 0 | 0 | 0 | 0 | ≦0.010 |
| 78 | 0 | 0 | 0 | 0 | " |
| 79 | 0 | 0 | 0 | 0 | " |
| 80 | 0 | 0 | 0 | 0 | " |
| 81 | 0 | 0 | 0 | 0 | " |
| 82 | 0 | 0 | 0 | 0 | " |
| 83 | 0 | 0 | 0 | 0 | " |
| 84 | 0 | 0 | 0 | 0 | " |
| 85 | 0 | 0 | 0 | 0 | " |

What is claimed is:

1. A seawater-corrosion-resistant non-magnetic steel material consisting essentially of, by weight:

C: not more than 1.0%
Si: not more than 0.25%
Mn: not more than 2.0%
Al: more than 20.0 to 37.3%
P: not more than 0.015%
S: not more than 0.005%
Cr: more than 5.5 to 15.0%
Balance: iron and unavoidable impurities.

2. A steel material according to claim 1, which further contains at least one rare earth element in a total amount in the range of from 0.01 to 0.5%.

3. A steel material according to claim 1, which further contains at least one of Ti, V, Nb, W, Co, Mo, and B in a total amount ranging from 0.01 to 0.5% for the elements other than B and in an amount ranging from 0.0001 to 0.005% for B.

4. A steel material according to claim 1, which further contains at least one rare earth element in a total amount in the range of from 0.01 to 0.5% and at least one of Ti, V, Nb, W, Co, Mo and B in a total amount ranging from 0.01 to 0.5% for the elements other than B and in an amount ranging from 0.0001 to 0.005% for B.

5. A steel material according to any of claims 1 to 4, which further contains at least one of Cu and Ni in a total amount ranging from 0.1 to 5.5%.

6. A steel material according to any of the claims 1 to 4, which further contains from 0.01 to 0.5% Pb.

7. A steel material according to any of claims 1 to 4, wherein the C content is from 0.001 to 0.1%.

8. A steel material according to any of claims 1 to 4, wherein the Si content is not more than 0.05%.

9. A steel material according to any of claims 1 to 4, wherein the Mn content is not more than 1%.

10. A steel material according to any of claims 1 to 4, wherein the Al content is from 20.5 to 28.0%.

11. A steel material according to any of the claims 1 to 4, wherein the Cr content is from 7.0 to 10.0%.

12. A steel material according to claim 5, which further contains from 0.01 to 0.5% Pb.

13. A steel material according to claim 2, wherein the rare earth element is at least one of Ce, La and Y.

14. A steel material according to claim 4, wherein the rare earth element is at least one of Ce, La and Y.

15. A steel material according to claim 1, wherein the Al content is from 20.5 to 37.3%.

16. A steel material according to claim 1, wherein the Mn content is from 0.01 to less than 2.0%.

* * * * *